US005642682A

United States Patent [19]

Pierce

[11] Patent Number: 5,642,682

[45] Date of Patent: Jul. 1, 1997

[54] RECOVERABLE TRIMARAN

[76] Inventor: Wayne M. Pierce, 301 Main St., Vestal, N.Y. 13850

[21] Appl. No.: 588,788

[22] Filed: Jan. 19, 1996

[51] Int. Cl.[6] ..... B63B 1/00

[52] U.S. Cl. ..... 114/61; 114/123

[58] Field of Search ..... 114/39.1, 39.2, 114/61, 88, 89, 90, 123, 282, 283, 292

[56] References Cited

U.S. PATENT DOCUMENTS

| | | | |
|---|---|---|---|
| 942,687 | 12/1909 | White | 114/61 |
| 4,655,154 | 4/1987 | Leonard | 114/91 |
| 4,730,570 | 3/1988 | Harris | 114/61 |
| 4,802,433 | 2/1989 | Kovac | 114/61 |
| 4,836,120 | 6/1989 | Murphy | 114/61 |
| 5,277,142 | 1/1994 | Conner | 114/61 |

*Primary Examiner*—Stephen Avila
*Attorney, Agent, or Firm*—Salzman & Levy

[57] ABSTRACT

The present invention features a trimaran-styled vessel that can recover from capsizing. The recoverable trimaran is made up of a specifically configured main hull with retractable, asymmetrical amas; internal, water-ballast tanks; a raised, buoyant, stern deck; and a specifically located main hatch. These components are sized according to the requirements of the prospective owner, yet within the confines of conventional, naval-engineering practices. The main hull has dead-end sockets in which the beams supporting the amas are attached and can be retracted. The main hull also includes longitudinal hollows in the lower portion of each side to allow the nesting of the amas in close proximity to the main hull. Retracting the beams places the amas adjacent the main hull, within the hollows. With the amas retracted, the cross-section of the main hull and amas resembles a circle. This configuration, combined with separately compartmentalized water-ballast tanks located below the beam sockets, and a ballast tank/skeg, produces a low center of gravity (CG). These ballast tanks usually remain empty, but, in the event of capsizing, they are filled by using a set of pumps, in combination with a series of diverter valves, to produce the low CG required to provide a righting force.

26 Claims, 5 Drawing Sheets

RECOVERABLE TRIMARAN

FIELD OF THE INVENTION

The present invention pertains to watercraft and, more particularly, to a lightweight, trimaran watercraft vessel that is capable of high speed; nearly unsinkable; and, most importantly, able to right itself after capsizing.

BACKGROUND OF THE INVENTION

The focus of much study, watercraft stability is central to the proper design of all vessels. The obvious need for stability influences all decisions regarding shape, location and weight of the many components required to produce a practical and safe watercraft. The two primary aspects of stability that need to be addressed when designing a vessel are fore-and-aft stability (pitch) and side-to-side stability (roll). Pitch stability does not pose as thorny a design problem as roll stability, since each of the buoyant parts of vessels have greater length than width.

The most influential factor affecting roll stability is form stability, i.e., the shape or distribution of the buoyant component(s), such as the hull. A vessel's form stability is a product of its center of gravity (CG), and its center of buoyancy (CB) such that they result in a righting moment that must be able to resist the capsizing forces of wind and/or sea conditions.

There are three common hull forms in use today: monohull, catamaran and trimaran. The resulting moments of each design tend to keep the vessels in an upright position. All hull designs use a combination of factors to ensure roll stability in most conditions.

Any vessel can occasionally expect to encounter severe wind and sea conditions that challenge and overcome both the skill of the crew and the design of the vessel. In such situations a breakup or capsizing of the vessel can occur. Capsizing is not necessarily a catastrophic situation for small craft. There have been many recorded incidents of small craft that have capsized at sea in which the vessel has righted itself and/or the crew has survived long enough to be rescued.

To date, only ballasted monohull sailing craft or specialized, monohull lifesaving powercraft are known to have the ability to right themselves from capsizing, owing to the location of their CG, the centralized location of the CB and the omission or small size of hatches in the hull. Small, lightweight monohulls and multihulls, without interior accommodations, usually have the ability to be righted by their crew. Large multihulls, on the other hand, resist efforts to be righted by the very same forces that provide for their upright stability. This is due to the wide beam and distribution of buoyancy, combined with the rigid construction arrangement of these craft. Even multihulls with folding amas/beams are difficult, if not impossible, to right. Usually the flooding of the main hull, the location of the amas when in the folded position, and the overturning moment of the raised mast prevent such righting. The ballasted monohull tends to roll back to the upright position, whereas the multihull resists any rolling to the upright position.

Most, if not all, monohulls over twenty feet long are dependent upon the use of ballasting for maintaining stability. In some designs, stability is augmented by the use of water ballast tanks that are mounted low in the hull. However, in using this type of stability procedure, monohulls have demonstrated their potential for sinking, in the event of a breakup or capsizing, due to their specific gravity being greater than that of water. Particularly when hatches are open, broken or non-watertight, monohulls can be inundated by large waves, which flood and sink the craft. Positive flotation techniques, such as the use of foam or air tanks, are not an answer to this problem; although they have been used with success, foam or air tanks significantly reduce the usable interior volume of a vessel.

Multihull vessels obtain their stability by distributing their buoyancy between two or three spaced-apart hulls. This eliminates the need for ballast. As a result of the lack of ballast, the multihull vessel has a general tendency to float even when flooded. The typically lightweight construction of this type of vessel also aids in keeping the craft afloat. However, a multihull can sink, if it is constructed of materials resulting in a total specific gravity greater than that of water. In such a case, though, positive flotation can be employed, in lesser quantities than in ballasted monohulls. The amas of a trimaran are ideal locations for the flotation materials; this is especially advantageous, in that the main hull storage and/or accommodations are thus not reduced.

The common way to enter the hull(s) of both monohulls and multihulls is through a water-resistant (albeit not watertight), sliding hatch or door located near the control location of the vessel, i.e., on the outer or topmost deck of the craft. However, this convenience allows this opening to submerge during capsizing. Water may also enter from a large wave. Such a construction can result in the possible compromise of the structural integrity of this primary entrance. Hence, there is a probability of flooding of the hull and the resultant sinking of the vessel. In addition, this construction reduces the possibility of righting the vessel. In the case of a monohull, the vessel may roll back upright quickly enough so that only a small amount of flooding will occur through the water-resistant hatch. However, due to the wide distribution of buoyancy, the multihull cannot quickly roll to an upright position, which will result in the flooding of the vessel.

In terms of performance, based on a strict speed-to-length ratio, multihulls require less power than monohulls of similar size to achieve equal speeds. Conversely, with equal power input, multihulls can achieve higher speeds than monohulls. This relationship is due to the reduced form resistance of the multihull's lighter, narrow hulls (in contrast to the wider, heavier form of a monohull of equal capacity and/or length).

The present invention is a watercraft design that combines the light, buoyant, and easily driven form of a multihull that can be reconfigured to produce a monohull's centralized buoyancy and resultant righting ability. The inventive design includes resistance to sinking or swamping by using properly located and designed primary entrances, in conjunction with the use of well-placed flotation material, the latter of which does not sacrifice interior usage space. The overall result is a watercraft that is faster and safer than other such vessels of similar size.

SUMMARY OF THE INVENTION

The present invention features a trimaran-styled watercraft that, after capsizing, can be easily righted by its crew. There are several novel features to the trimaran of this invention, the first of which is the use of a cylindrically-styled center (main) hull with longitudinal, concave, lower quadrants. The lower quadrants are disposed on each side; the two secondary hulls (amas) of the trimaran are designed to nest within these quadrants. The amas are connected through a dual-axis pivot to mechanically-actuated beams, which slide within sockets that pass through the main hull. These sockets are perpendicular and approximately horizontal to the longitudinal axis of the main hull. The sliding action allows the amas to be extended or retracted. Extending the amas provides the primary stability necessarily inherent in trimaran operation. Retracting the amas produces a single, centralized, cylindrical mass, thus providing a desired center of buoyancy; additionally provided by the arrangement is a low, centralized center of gravity. This desirable combination allows for the righting of the vessel in the event of capsizing. The pivots allow the amas to follow the least-resistive path through the water, allowing for a greater speed potential. This results from the freedom of each ama to pitch (rotating about a horizontal axis of the vessel, perpendicular to the longitudinal axis) or yaw (rotating about the vertical axis), as sea conditions dictate. The inclusion of the pivoting feature also allows the amas to "give" when hitting an obstruction, while still providing the necessary righting moment to maintain stability. Each ama includes a small fin (skeg) at its stern so as to provide directional stability while under way. A spring-type mechanism between each ama and its supporting beam is also provided so as to realign the ama after hitting an obstruction.

The second novel feature of the inventive trimaran is the placement of water ballast tanks below the beam sockets. Regardless of the vessel's vertical orientation, the ballast tanks can be filled or evacuated by using manual or electric pumps, in conjunction with a series of diverter valves. In trimaran sailing craft, this water ballast arrangement is augmented by the use of a hollow, fin-like, skeg tank mounted on the bottom of the hull. This skeg tank doubles as an additional ballast tank and helps to offset the overturning moment induced by the mast and the rigging. The skeg tank is also required to restrict sideward movement of the vessel, resulting from the wind pressure on the sails, converting sideward motion to a forward motion. This tank arrangement increases the stability of powered craft by lowering the CG well below the longitudinal axis of the main hull. However, in sailing trimarans, the mast(s) and rigging will place the CG adjacent the longitudinal axis, thereby reducing or eliminating the positive righting moment required for self-righting. To place the CG of the sailing trimaran such that it provides the required righting moment, the invention provides a convenient means for raising and lowering the mast(s). In addition, the mast(s) is filled with a flotation material to assist in the righting of the vessel, when capsized.

The third novel feature of this invention is the inclusion of a raised stern deck. Such a construction incorporates enough flotation material (styrofoam) to provide sufficient displacement at the stern. This prevents the submerging of the primary entrance hatch in the event of a capsize, thereby helping to prevent flooding of the main hull. This use of flotation material also helps to prevent sinking.

The fourth novel feature of the invention, in conjunction with the aforementioned third feature, is the location of a watertight, primary entrance, door-type hatch placed in the approximate center of the primary, athwartship, exterior wall (bulkhead) of the main hull. Regardless of the vertical orientation of the main hull about the longitudinal axis of the craft, this hatch will remain above the waterline of the main hull. This positioning helps to ensure that the main hull will be prevented from flooding, in the event of capsizing. The watertight construction provides a positive means of securing the interior volume from larger waves that might submerge the opening.

In the event of capsizing, the crew would first close any open ventilation and access hatches. Then, using the diverter valves to control the flow direction, any water within the main hull would be pumped either to the exterior or into the empty ballast tanks. Any additional water required to fill the ballast tanks would be pumped in from outside the vessel. After this is accomplished, the amas would be fully retracted to provide a "single" hull configuration. A motorized trimaran would then roll back into the upright position due, to its low CG and the cylindrical nature of the now "single" hull arrangement. In sailing trimarans, the hull would only rotate to the 90-degree position, due to the CG of the mast(s) and rigging. At this point, the crew exit the craft through the main hatch, which is above the water. Using the pivot mechanism(s) provided, the crew can lower the mast(s) so that it is parallel, and in close proximity to, the main hull. In so doing, the CG will return to the lower location, whereupon the vessel will then roll to the upright position.

After the vessel rolls to the upright position, the amas can be extended to their maximum reach, further stabilizing the craft. The ballast tanks can now be emptied. The crew can now raise the mast(s) and get under way.

BRIEF DESCRIPTION OF THE DRAWINGS

A complete understanding of the present invention may be obtained by reference to the accompanying drawings, when reviewed in conjunction with the detailed description, in which.

For the sake of brevity and clarity, like elements and components will bear the same numerical designations throughout the FIGURES.

DISCUSSION OF THE PREFERRED EMBODIMENT

Generally speaking, the invention pertains to a trimaran watercraft. The inventive trimaran is recoverable due to several mechanisms that function together so as to prevent the flooding of the vessel's main hull, and allow it to be righted from a capsized position.

Figure 1:
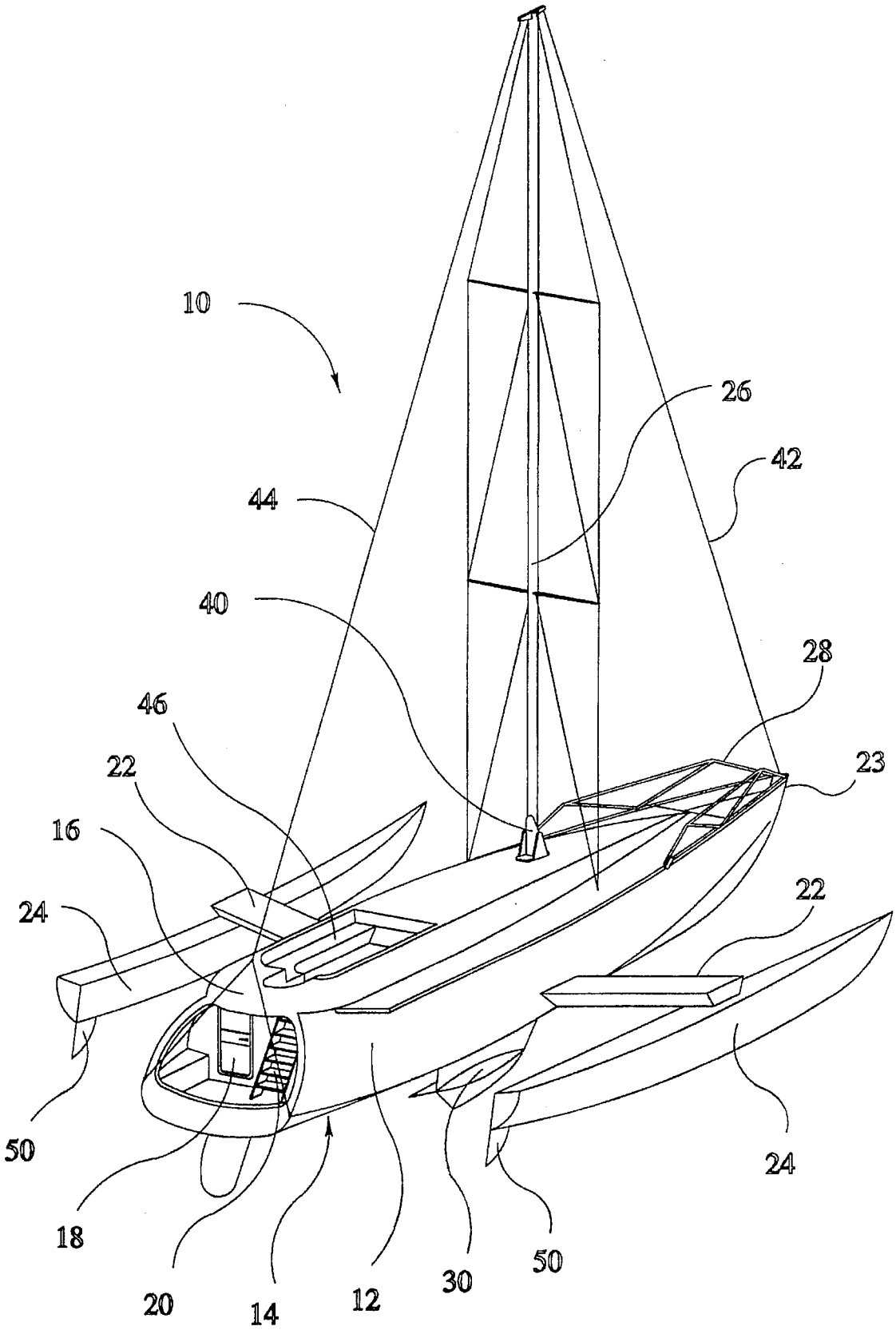
FIG. 1 illustrates a perspective view of the preferred embodiment of the sailing craft of this invention.

Now referring to FIG. 1, the recoverable, self-righting trimaran 10 of this invention is shown. The substantially cylindrically-shaped main hull 12 incorporates the lower quadrant hollows 14, the raised floating stern deck 16, the operations cockpit 46, the main hatch 18 and the stairway 20. The respective starboard and port side ama beams 22, which are connected to the respective starboard and port side amas 24, slide into the hollow, main hull sockets 32 (shown in FIGS. 2, 3, 4*a*, 4*b*, 5*a* and 5*b*) located within the main hull 12. Each ama beam 22 is connected to the interior, far wall 21 of the socket 32 via the extension rod 35, which extends from cylinder 34 disposed within the ama beam 22, and which allows for the amas 24 and ama beams 22, respectively, to be extended or retracted, as required. In sailing craft, the mast(s) 26, tabernacle 40, lever arm 28, forestay 42 and skeg tank 30 are also connected to this main hull 12. All of these components can be sized according to the desires of the prospective owner, yet within the constraints of conventional naval engineering practices.

Figure 2:
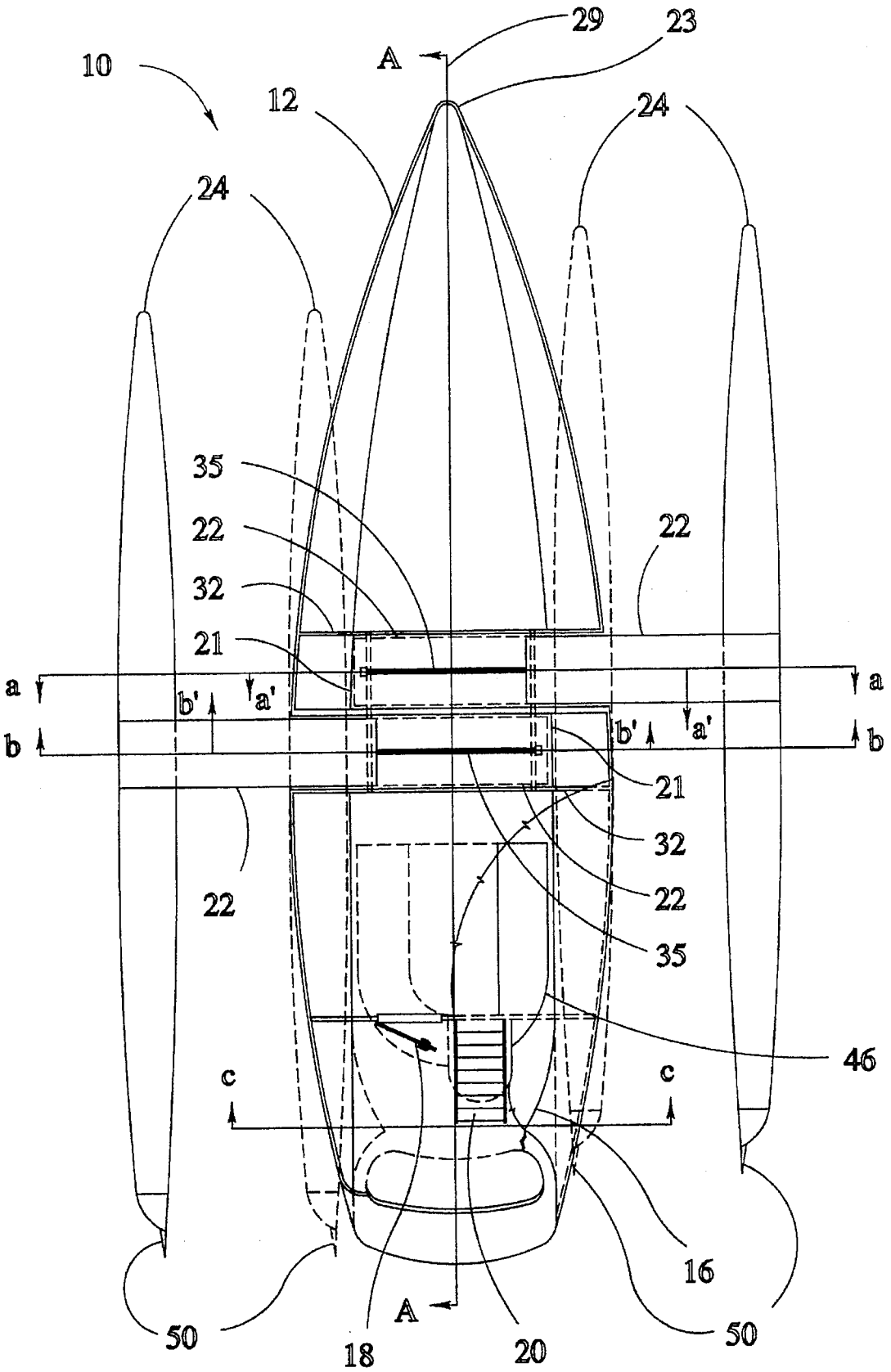
FIG. 2 depicts a sectional, plan view of the sailing craft shown in FIG. 1, with the amas depicted in a retracted position in phantom view, and the main hull interior shown in a partial, cut-away view.

Referring to FIG. 2, the recoverable, self-righting trimaran 10 is depicted in solid lines in its operational configuration with the amas 24 and ama beams 22 extended. The phantom lines depict the amas 24 and ama beams 22 in their retracted positions. Included in this view are a horizontal section of the main hatch 18 and the stairway 20 required for access to the raised, floating stern deck 16 and operations cockpit 46. Secured within the main hull sockets 32 by the extension rods 35 are the ama beams 22. The ama beams 22 are affixed to the amas 24 through the dual axis pivots 36 (not visible). It should be understood that means other than cylinder-and-rod actuators can be used for retracting and extending the amas 24, without departing from the scope of this invention. Such alternatives could include, but are not limited to, a winch-and-cable system, a helical screw mechanism, etc. In addition, the number of beams supporting the amas need not be restricted, as multiple beams can be extended, in coordination with each other, to provide the required support. This type of approach would eliminate the use of dual-axis pivots 36. All of these alternatives are well known to those skilled in the art. The cylinder-and-rod actuators can be manually- and/or pneumatically- or hydraulically-powered.

Figure 3:
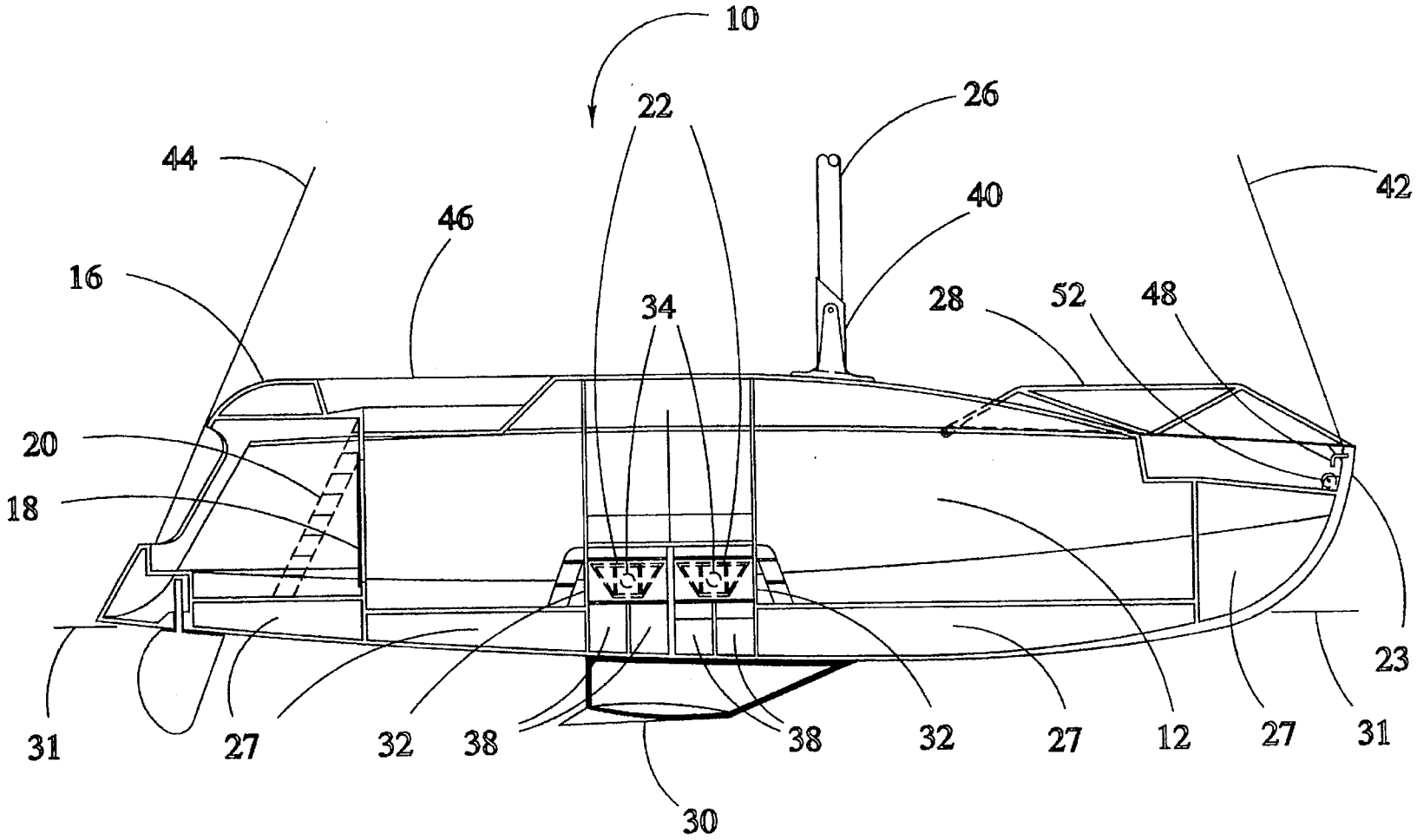
FIG. 3 shows a sectional, profile view, taken along lines A—A of the main hull depicted in FIG. 2.

Referring to FIG. 3, the main hull 12 is depicted in a longitudinal, sectional view. This profile view shows the general location of the sockets 32, the water ballast tanks 38, the flotation incorporated in the raised floating stern deck 16, the operations cockpit 46, the backstay 46, mast tabernacle 40, the lever arm 28, the forestay 42, the lever arm retaining pin 48, turning block 52, the skeg tank 30, the main hatch 18, the stairs 20, and the waterline 31. The trapezoidal cross-sections of both ama beams 22 and extension cylinders 34 are shown in phantom. Also apparent are the void areas of the lower portion of the main hull 12, which can also be used for additional flotation (the areas 27, in particular, at the ends of the main hull 12).

Located within the main hull 12 and below each main hull socket 32 are water ballast tanks 38, any of which may be interconnected to allow simultaneous filling. The water ballast tanks 38 can be filled or voided by pumps (not shown), as is well known in the art. A series of diverter valves (not shown) direct the flow at both the intake and output sides of the water pump(s). These pump(s) can also be connected, via the diverter valves, to the skeg tank 30.

On sailing craft, the mast(s) 26 is mounted in tabernacle (s) 40 and filled with flotation material, such as styrofoam. For the conventional, Marconi-rigged, single-masted vessel 10 (illustrated), a permanently-mounted lever arm 28 is mounted, with its apex at the bow end 23 of the main hull 12. Lever arm 28 is in the form of an "A"-frame and doubles as a handrail. It is hinged at the aft mounting points in the vicinity of the mast tabernacle 40 on each side of the main hull 12, and is restrained at the apex, by being secured to the main hull 12 by a removable locking pin 48. The mast 26 is connected to this lever arm 28 by the headstay 42, which is one of the support wires for both the mast and the forward sail. This allows the mast 26 to be lowered or raised by the lever arm 28 in a controlled manner, by using an anchor winch (not shown).

Other alternatives to the conventional, Marconi rig shown here can be a two-masted rig, or a free-standing mast(s) mounted in enhanced tabernacles and raised or lowered by a rod and cylinder, which may eliminate the need for the lever arm 28. Any of these alternatives can be used without departing from the scope of this invention.

Figure 4A:
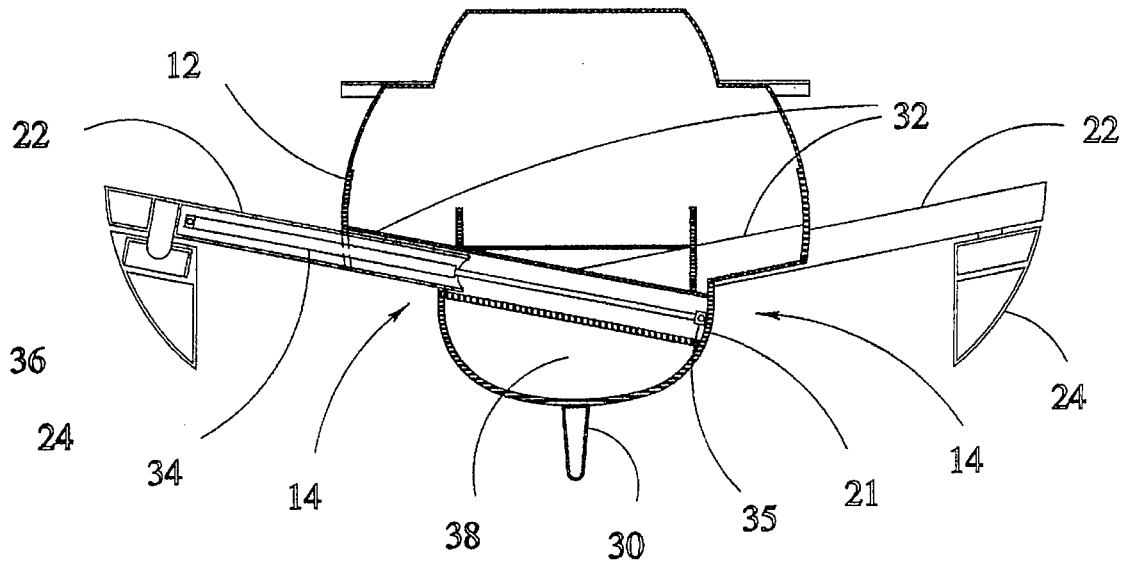
FIG. 4*a* illustrates a sectional view taken along lines a—a of the main hull of the sailing craft shown in FIG. 2, with the amas in an extended position.

Referring to FIG. 4*a*, the main hull 12 is depicted in a sectional view. This view shows the vessel 10 in its operational mode with the ama beams 22, amas 24, dual axis pivots 36, and the extension rod 35 extended from cylinder 34. This view also shows the lower quadrant hollows 14 (where the amas 24 nest when in the retracted position), the socket 32 for the ama beam 22, the cross-sectional shape of the amas 24, the location of the water ballast tank 38 and a section of the skeg tank 30. This view also shows the angle that the socket 32 and ama beams 22 must make, in order to provide the low CG stability required for recovery. This angle is approximately eleven degrees above the horizontal, but is dependent on factors relating to the overall beam of the lower part of the main hull 12, the accommodations desired by the prospective owner, and the volume of the amas 24 required for adequate stability. Other, alternative angles; the ama cross-sections; and the water ballast tank locations may also be dictated by these design factors, and are well known to those skilled in the art.

Figure 4B:
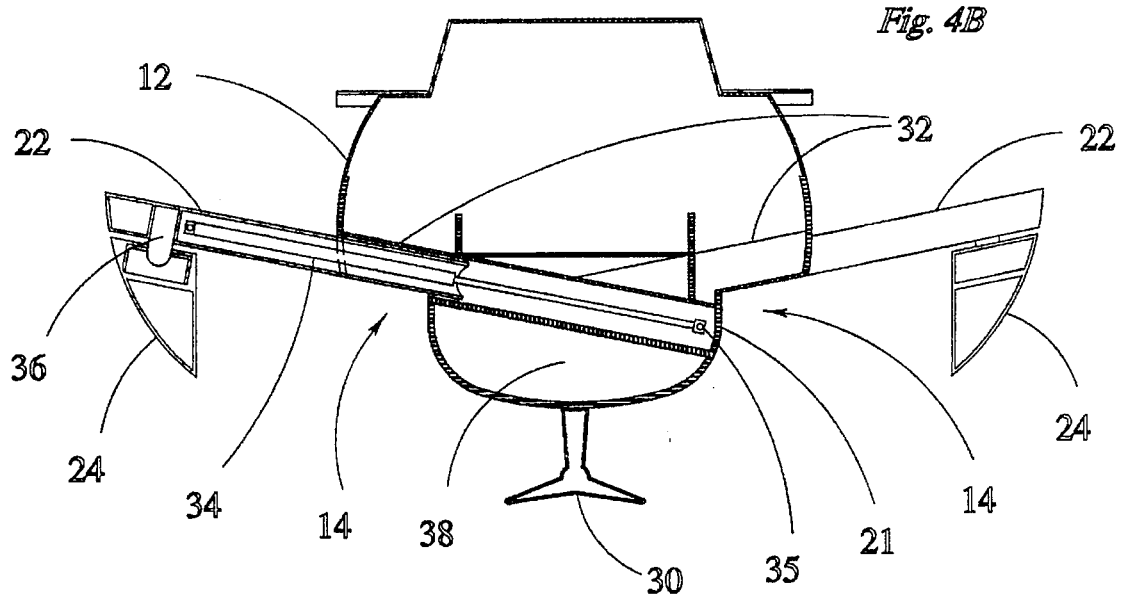
FIG. 4*b* illustrates a sectional view taken along lines b—b of the main hull of the sailing craft shown in FIG. 2, with the amas in an extended position.

Referring to FIG. 4*b*, the main hull 12 is depicted in a sectional view. This view shows the vessel 10 in its operational mode with the ama beams 22, amas 24, dual axis pivots 36 and the extension rod 35 in an extended position with respect to cylinder 34. This view also shows the lower quadrant hollows 14 (where the amas 24 nest when in the retracted position), the socket 32 for the ama beam 22, the cross-sectional shape of the extended amas 24 and the location of the water ballast tank 38. This view also shows the angle that the socket 32 and ama beams 22 must make, in order to provide the low CG stability required for recovery. This angle, again, is approximately eleven degrees above the horizontal, but is dependent on a number of design factors relating to the overall beam of the lower part of the main hull, the accommodations desired by the prospective owner, and the volume of the amas required for adequate stability. Other, alternative angles; cross-sections; and water ballast tank locations may also be dictated by these design factors, and are well known to those skilled in the art.

Figure 5A:
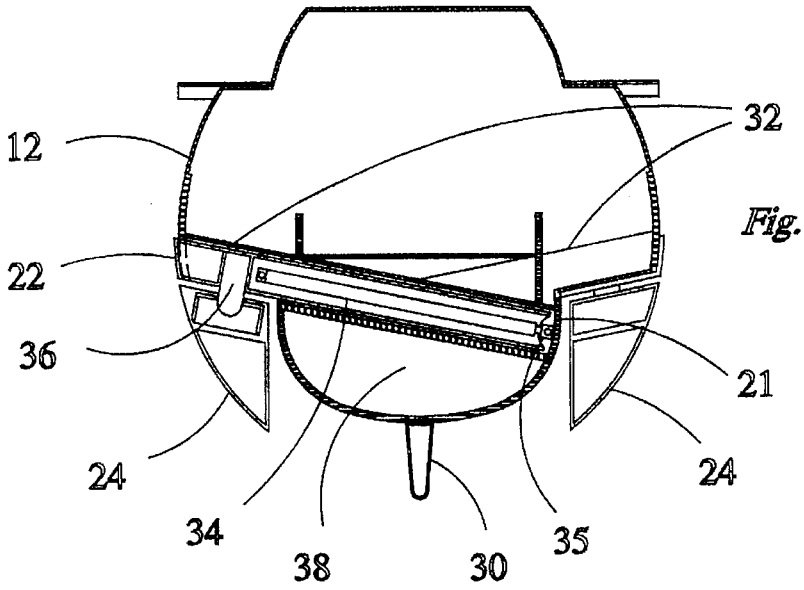
FIG. 5*a* depicts a sectional view taken along lines a'—a' of the main hull of the sailing craft shown in FIG. 2, with the amas in a retracted position.

Referring to FIG. 5*a*, the main hull 12 is depicted in a sectional view. This view shows the vessel 10 in its recovery mode with the amas 24 connected to the ama beams 22 by dual axis pivots 36, and the ama beams 22 retracted into sockets 32, and extension rod 35 retracted into cylinder 34. This view also shows the amas 24 nested within the lower quadrant hollows 14. Also shown is the cross-sectional shape of the amas 24, and the location of the water ballast tank 38. This view also shows the angle that the socket 32 and ama beams 22 must make, in order to provide the low CG required for recovery. This angle is approximately eleven degrees above the horizontal, but is dependent on a number of design factors relating to the overall beam of the lower part of the main hull, the accommodations desired by the prospective owner, and the volume of the amas required for adequate stability. Other, alternative angles; ama cross-sections; and water ballast tank locations may also be dictated by these design factors, and are well known to the skilled practitioner.

Figure 5B:
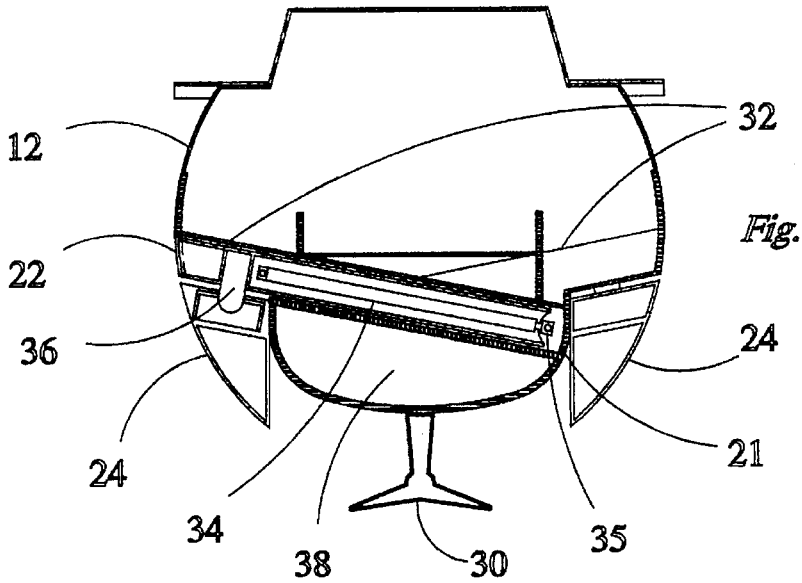
FIG. 5*b* depicts a sectional view taken along lines b'—b' of the main hull of the sailing craft shown in FIG. 2, with the amas in a retracted position.

Referring to FIG. 5*b*, the main hull 12 is depicted in a sectional view. This view shows the vessel 10 in its recovery mode with the amas 24 connected to the ama beams 22 by dual axis pivots, and the ama beams 22 retracted into sockets 32, and extension rod 35 retracted into cylinder 34. This view also shows the amas 24 nested in the lower quadrant hollows 14. Also shown is the cross-sectional shape of the amas 24, and the location of the water ballast tank 38. This view also shows the angle that the socket 32 and ama beams 22 must make, in order to provide the low CG required for the ability for recovery. This angle is approximately eleven degrees above the horizontal, but is dependent on factors related to the overall beam of the lower part of the main hull, the accommodations desired by the prospective owner, and the volume of the amas required for adequate stability. Other alternative angles; ama cross sections; and water ballast tank locations may also be dictated by these design factors, and are well known to those skilled in the art.

Figure 5C:
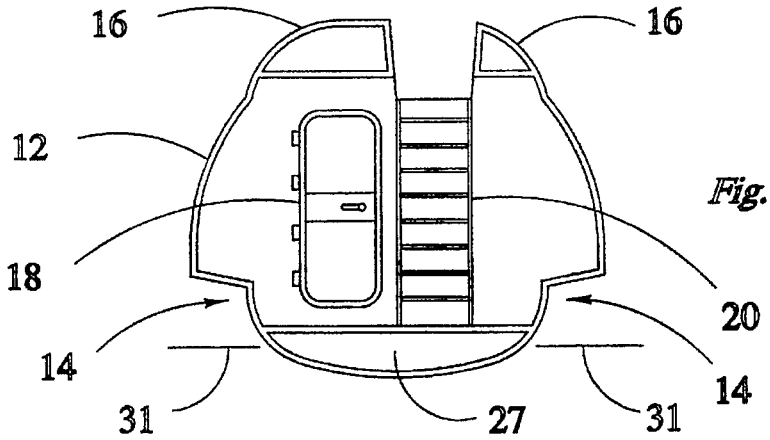
FIG. 5*c* shows a sectional view taken along lines c—c of the main hull of the sailing craft illustrated in FIG. 2.

Referring to FIG. 5*c*, the main hull 12 is depicted in a sectional view. This view shows the rearward location of the main hatch 18 along the longitudinal axis 29 (FIG. 2) of the main hull 12. The hatch 18 is above the vessel's waterline 31, regardless of the vertical orientation of the main hull 12. This primary-entrance hatch 18 is of watertight construction, and is built according to the accepted standards for water-tight hatches that are currently used in mass-produced pleasure vessels. This hatch incorporates a conventional door latch for ease of use. Also shown in this view is a section of the raised, floating stern deck 16 that provides sufficient displacement at the stern, so as to prevent the primary-entrance hatch 18 from being submerged in the event of capsizing.

In the event of capsizing, the crew's first response would be to close all open hatches. This action is enhanced by the raised, floating stern deck 16 which helps to prevent the main hatch 18 from being submerged during the time that the vessel is capsized. Any water taken on during the capsizing would next be pumped out of the main hull 12, filling the ballast tanks 38 and skeg tank 30 (if not already filled), by using the water pumps (not shown) and the diverter valves (not shown). Once this is accomplished, the crew then retracts the ama beams 22 and amas 24, using either the pneumatic pump(s) (not shown) or the manually- or electrically-driven hydraulic pump(s) (not shown) to retract the extension rods 35. The ama beams 22 will retract into their respective sockets 32, and amas 24 will nest in their respective lower quadrant hollow 14. With the amas 24 and ama beams 22 retracted, the vessel will rotate to the 90-degree position owing to the centralized CB, the low CG of the entire structure, and the buoyancy of the foam-filled mast(s) 26.

At this point in the righting process of a sailing craft, the crew must exit the interior of the main hull 12 through the main hatch 18, which is above the waterline of the 90-degree hull, and lower or remove any sails. Primarily to prevent damage to the sails, this is also essential to further reduce the weight in the top half of the vessel. Secondly, a midpoint halyard (not shown) located at the midpoint of the mast 26 is connected to an attachment point at the stern of the main hull 12. Any other piece of running rigging (not shown) that may have been in use at the time of the capsizing must also be loosened or removed, so as not to interfere with the lowering of the mast 26. Also at this time the backstay 44 is loosened. Either a manual downhaul (not shown) or the anchor rode (not shown), via the anchor or alternative winch (not shown), is attached to the apex of the lever arm 28, after running through a turning block 52 located below the apex of the lever arm 28 and attached to the apex of the lever arm 28. After these tasks are performed, the retaining pin 48 connecting the apex of the lever arm 28 to the bow 23 of the main hull 12 is removed. The midpoint halyard (not shown) is now winched in from the operations cockpit 46. In so doing, the mast 26 is pulled toward the main hull 12, pivoting about the mast tabernacle 40 hinge point.

As the mast 26 moves closer to the main hull 12, the vessel will begin to rotate to the upright position, due to the altering of the vessel's CG. After the vessel has completed the righting process, the crew would re-extend the ama beams 22 and amas 24 to further stabilize the craft. In a sailing craft, the crew would raise the mast 26, using the anchor capstan (not shown) or the manual downhaul. They would then re-pin the lever arm 28, and, finally, raise the sails.

Since other modifications and changes may be varied to fit particular purposes and environments, as will be apparent to those skilled in the art, the invention is not considered to be limited to the specific embodiments chosen for purposes of disclosure and covers all changes and modifications which do not constitute departures from the true spirit and scope of this invention.

Having described the invention, what is desired to be protected by Letters Patent is presented in the appended claims.

What is claimed is:

1. A recoverable, trimaran watercraft, comprising:

a watercraft including a main hull having a longitudinal axis wherein said main hull comprises a substantially cylindrical geometry;

means defining a pair of longitudinal lower quadrant hollows supported by said main hull and disposed parallel to and below said longitudinal axis;

means defining a main hatch, located substantially proximate said longitudinal axis of said main hull, situated above the waterline of said watercraft, regardless of the vertical orientation thereof;

means defining a pair of hollow sockets supported by said main hull, below said longitudinal axis, for respectively receiving a respective one of a pair of ama beams therein; and a pair of retractable amas, each having said ama beams extending from and supported by said respective hollow sockets supported by said main hull, said retractable amas providing form stability when extended from said main hull, allowing said watercraft to be righted when each ama is retracted adjacent said main hull and nested substantially in said longitudinal hollows via retraction of its respective ama beam.

2. The recoverable trimaran in accordance with claim 1, wherein, when said amas are retracted and proximate said main hull via nesting substantially within said longitudinal hollows, the geometry of said amas and main hull comprises a substantially cylindrical shape.

3. The recoverable trimaran in accordance with claim 1, further comprising water ballast tanks disposed below said longitudinal axis.

4. The recoverable trimaran in accordance with claim 1, further comprising a mast tabernackle, disposed atop and supported by said main hull, permiting the raising or lowering of the mast, thereby enabling the righting of said watercraft when capsized.

5. The recoverable trimaran in accordance with claim 1, further comprising a dual axis pivot between said amas and said ama beams allowing for the ability of said amas to seek the least resistive path through the water while said watercraft is in motion.

6. The recoverable trimaran in accordance with claim 1, wherein said means defining a pair of hollow sockets further comprises a cylinder and rod operatively connected to each one of said pair of ama beams for extending and retracting said ama beams with respect to said main hull.

7. The recoverable trimaran in accordance with claim 8, wherein said cylinder and rod means comprises a hydraulically-actuated mechanism.

8. The recoverable trimaran in accordance with claim 1, a cable and winch mechanism for retracting and extending said amas beams relative to said main hull, hence, extending and retracting said amas.

9. The recoverable trimaran in accordance with claim 6, further comprising a cylinder and rod operatively connected to said mast tabernackle, for raising or lowering the mast, thereby enabling the righting of said watercraft when capsized.

10. A recoverable, trimaran watercraft, comprising:

a watercraft including a main hull having a longitudinal axis;

means defining a pair of longitudinal lower quadrant hollows supported by said main hull and disposed below said longitudinal axis;

a hatch disposed in said main hull, above a waterline thereof, and means defining a raised, buoyant, stern deck disposed above and supported by said main hull, said buoyant, stern deck being capable of supporting said main hull when said watercraft is capsized, thereby preventing submersion of said hatch; and a pair of retractable amas, each of said amas having a beam extending from and supported by said main hull, said retractable amas providing form stability when extended from said main hull, and said retractable amas allowing said watercraft to be righted when each ama is retracted adjacent said main hull and nested substantially in said longitudinal hollows via retraction of its respective ama beam.

11. The recoverable trimaran in accordance with claim 10, wherein, when said amas are retracted and proximate said main hull via nesting substantially within said longitudinal hollows, the geometry of said amas and main hull comprises a substantially cylindrical shape.

12. The recoverable trimaran in accordance with claim 10, further comprising water ballast tanks disposed below said longitudinal axis.

13. The recoverable trimaran in accordance with claim 11, further comprising a mast tabernackle, disposed atop and supported by said main hull, permiting the raising or lowering of the mast, thereby enabling the righting of said watercraft when capsized.

14. A recoverable, trimaran watercraft, comprising:

a watercraft including a main hull having a waterline and a longitudinal axis; means defining a hatch in said main hull, said hatch being disposed above said waterline regardless of main hull orientation;

means defining a pair of longitudinal lower quadrant hollows supported by said main hull and disposed parallel to and below said longitudinal axis;

a raised, buoyant, stern deck disposed above and supported by said main hull, said buoyant, stern deck being capable of supporting said main hull when said watercraft is capsized, thereby preventing submersion of said hatch, which, in turn, prevents the flooding of said main hull of said watercraft, thereby enabling the righting of said watercraft when capsized; and a pair of retractable amas, each of said amas having beams extending from and supported by said main hull, said retractable amas providing form stability when extended from said main hull, and said retractable amas allowing said watercraft to be righted when each ama is retracted adjacent said main hull and nested substantially in said longitudinal hollows via retraction of its respective ama beam.

15. The recoverable trimaran in accordance with claim 14, wherein, when said amas are retracted and proximate said main hull via nesting substantially within said longitudinal hollows, the geometry of said amas and main hull comprises a substantially cylindrical shape.

16. The recoverable trimaran in accordance with claim 14, further comprising water ballast tanks disposed below said longitudinal axis.

17. A recoverable, trimaran watercraft, comprising:

a watercraft including a main hull having a longitudinal axis, wherein said main hull comprises a substantially cylindrical geometry;

means defining a pair of longitudinal, lower-quadrant hollows, supported by said main hull and disposed parallel to and below said longitudinal axis;

a mast disposed on top of, and supported by, said main hull;

a mast tabernacle disposed on top of, and supported by, said main hull, permitting the raising or lowering of the mast, thereby enabling the righting of said watercraft, when capsized;

means defining a pair of hollow sockets supported by said main hull, below said longitudinal axis, for respectively receiving a respective one of a pair of ama beams therein; and a pair of retractable amas, each having said ama beams extending from and supported by said respective hollow sockets which are supported by said main hull, said retractable amas providing form stability when extended from said main hull, allowing said watercraft to be righted when each ama is retracted adjacent said main hull and nested substantially in said longitudinal hollows via retraction of its respective ama beam.

18. A recoverable, trimaran watercraft, comprising:

a watercraft including a main hull having a longitudinal axis, wherein said main hull comprises a substantially cylindrical geometry;

means defining a pair of longitudinal, lower-quadrant hollows, supported by said main hull and disposed parallel to and below said longitudinal axis;

means defining a raised, buoyant, stern deck disposed above and supported by said main hull, said buoyant, stern deck being capable of supporting said main hull when said watercraft is capsized, thereby preventing submersion of said main hatch, which, in turn, prevents the flooding of said main hull of said watercraft, thereby enabling the righting of said watercraft, when capsized;

means defining a pair of hollow sockets supported by said main hull, below said longitudinal axis, for respectively receiving a respective one of a pair of ama beams therein; and a pair of retractable amas, each having said ama beams extending from and supported by said respective hollow sockets which are supported by said main hull, said retractable amas providing form stability when extended from said main hull, allowing said watercraft to be righted when each ama is retracted adjacent said main hull and nested substantially in said longitudinal hollows via retraction of its respective ama beam.

19. A recoverable, trimaran watercraft, comprising:

a watercraft including a main hull, having a longitudinal axis;

means defining a raised, buoyant, stern deck disposed above and supported by said main hull, said buoyant, stern deck being capable of supporting said main hull when said watercraft is capsized;

means defining a watertight hatch disposed within said main hull, and disposed between the waterline thereof and said raised, buoyant, stern deck, proximate said longitudinal axis, said buoyant, stern deck having sufficient displacement to support said main hull, so that it is able to prevent the submersion of said hatch when said trimaran is capsized.

20. The recoverable, trimaran watercraft in accordance with claim 19, wherein said main hull comprises a substantially cylindrical, cross-sectional geometry, said cylindrical, cross-sectional geometry being interrupted by means defining a pair of longitudinal, lower-quadrant hollows, one on each side, supported by said main hull and disposed parallel to and below said longitudinal axis.

21. The recoverable, trimaran watercraft in accordance with claim 19, further comprising a pair of angled, dead-end, hollow sockets supported by said main hull, said sockets disposed below and perpendicular to said longitudinal axis, and skewed longitudinally with respect to each other, for respectively receiving a respective one of a pair of slidably affixed, angled ama beams therein, said angled, dead-end hollow sockets being of watertight construction, so that any flooding of the socket cannot enter the main hull.

22. The recoverable, trimaran watercraft in accordance with claim 21, further comprising a matching set of asymmetrical amas, said asymmetrical amas' outer surfaces comprising a quarter-circle, cross-section that approximately matches the radius of said main hull's cross-section, said asymmetrical amas' inner surfaces being designed to nest substantially within said main hull's lower-quadrant hollows, each ama having a respective one of a pair of said ama beams extending from and supported by said respective, angled, dead-end hollow socket supported by said main hull, said asymmetrical, retractable amas providing form stability when extended from said main hull via extension of its respective, angled, ama beam, and allowing said watercraft to be righted when each ama is retracted adjacent said main hull and nested substantially in said longitudinal hollows via retraction of its respective, angled, ama beam, the geometry of said radius providing minimum rolling resistance for capsize recovery.

23. The recoverable, trimaran watercraft in accordance with claim 22, further comprising a T-shaped, dual-axis pivot between said asymmetrical amas and said ama beams, said pivot allowing said asymmetrical amas to seek the least resistive path through the water while said watercraft is in motion, said dual-axis pivot connection being restricted to pitch and yaw motions.

24. The recoverable, trimaran watercraft in accordance with claim 23, said asymmetrical amas further incorporating stern fins, thereby allowing said amas to align themselves with said main hull by pivoting about the dual-axis pivot's vertical axis, while said recoverable trimaran is in motion.

25. The recoverable, trimaran watercraft in accordance with claim 22, further comprising separate, sealed, water-ballast tanks disposed below said longitudinal axis, said separate, sealed, water-ballast tanks being distinct from said vessel's interior accommodations, said water-ballast tanks being capable of holding sufficient water ballast so as to provide the required righting moment to right the vessel from a capsized position, when said asymmetrical amas have been nested within said longitudinal hollows and positioned proximate said main hull.

26. The recoverable, trimaran watercraft in accordance with claim 21, wherein said means defining a pair of angled, dead-end, hollow sockets further comprises a cylinder and rod, operatively connected to each one of a said pair of angled ama beams, for slidably extending and retracting said ama beams with respect to said main hull, thus moving said asymmetrical amas proximate said main hull within the confines of their respective longitudinal hollows, thereby providing minimum form stability for capsize recovery.

* * * * *